United States Patent [19]

Parker

[11] 3,976,881

[45] Aug. 24, 1976

[54] ARRANGEMENT FOR STABILIZING CORONA DEVICES

[75] Inventor: Delmer G. Parker, Irondequoit, N.Y.

[73] Assignee: Xerox Corporation, Stamford, Conn.

[22] Filed: Oct. 29, 1975

[21] Appl. No.: 626,816

[52] U.S. Cl. ..... 250/324; 250/326; 317/262 A

[51] Int. Cl.[2] ..... G03G 15/00

[58] Field of Search ..... 250/324, 325, 326; 317/262 A

[56] References Cited

UNITED STATES PATENTS 3,699,388 10/1972 Ukai ..... 250/324

*Primary Examiner*—Craig E. Church

[57] ABSTRACT

An arrangement for compensating for changes in the output of a corotron due to environmental changes. The arrangement includes a control corona device and a controlled corona device, the controlled corona device located in a xerographic reproduction machine in a position to deposit charge on an imaging surface and the control device located remote from said imaging surface and inoperative to deposit charge thereon, but exposed to some environmental conditions of pressure and temperature, etc. The output of the control corotron is used to generate a control signal which is fed back to control the controlled corotron which may be one or all of the corotrons used in the xerographic process.

4 Claims, 7 Drawing Figures

ARRANGEMENT FOR STABILIZING CORONA DEVICES

BACKGROUND OF THE INVENTION

This invention relates to xerography in general, and more particularly to corona devices used for charging and discharging imaging surfaces used in a xerographic process.

In xerography, uniform electrostatic charges deposited on the surface of a xerographic plate comprising a photoconductive insulating layer supported by conductive backing layer. Exposure to an optical image selectively dissipates the charge and the light struck areas, thus producing an electrostatic charge pattern in image configuration. An appropriate development process, such as dusting with an electroscopic powder which adheres to the charged areas, renders the latent image visible. This powder may then be transferred to a material such as paper by placing the material in face to face contact with the powder image and applying electrical charge to attract powder to the material surface. This copy may then be rendered permanent by fixing, such as by heat fusing.

In the above-noted electrographic process, electrostatic charging techniques are generally relied upon to accomplish such necessary steps as the transfer of an electrostatically formed image from a reusable photoreceptor structure to a transfer member and/or tacking and stripping operations associated with such transfer member.

While many forms of acceptable techniques for electrostatically charging a surface are known, corona discharge techniques have generally been preferred in applications such as those mentioned above because such techniques are particularly well suited to applying an electrostatic charge to a moving surface. In addition, the use of corono discharge techniques allows a selected surface to be rapidly charged to a relatively high potential. Conventional forms of corona generating apparatus are illustrated in U.S. Pat. Nos. 2,836,725 and 2,879,395 and generally comprise one or more wire-like electrodes, known as coronodes, horizontally disposed above the surface to be charged and a shield which may take a plurality of different structural forms, partially disposed about a coronode. In one conventional mode of operation, a high voltage d.c. power supply is connected to the coronode with the suitable polarity for the charging operation which is desired, while a conductive layer associated with the surface to be charged is grounded, as are the other terminal of the power supply and the shield.

In electrostatographic machines employing such corona devices, it is desirable to control the charge delivered within known limits. Thus to properly charge a moving xerographic imaging surface a specific rate of flow of charge to the imaging surface is required to obtain optimum copy quality. However, the output of such corona devices is affected by changes in the ambient conditions in which the device operates. Also, accumulations of toner, dust and chemical growths on the device alter its characteristics.

This invention is directed to an arrangement for compensating for the changes resulting from variations in the ambient conditions under which the corona discharge devices operate.

A control arrangement directed specifically to the problem of controlling the output of a corona device in response to changes in power supply voltage is shown in U.S. Pat. No. 3,122,634.

Another corona device control arrangement is shown in U.S. Pat. No. 3,244,683 in which two corona devices are connected across a common supply so that the amount of corona current leaving one corona device is equal and opposite to that entering the other corona device.

OBJECTS & SUMMARY OF THE INVENTION

It is, therefore, a primary object of the invention to improve the print quality from xerographic reproduction machines by reducing the affect of changes in ambient conditions on the corona charging devices of the machine.

This object and others are accomplished by an arrangement which includes a control corona device and a controlled corona device, the controlled corona device located in a xerographic reproduction machine in a position to deposit charge on an imaging surface and control devices located remote from said imaging surface and inoperative to deposit charge thereon but being exposed to the same or similar ambient conditions of pressure and temperature, etc. The output of the control corotron is used to generate a control signal which is fed back to control the controlled corotron, which may be one or all of the corotrons used in the xerographic process.

DESCRIPTION OF THE PREFERRED EMBODIMENT

Figure 1:
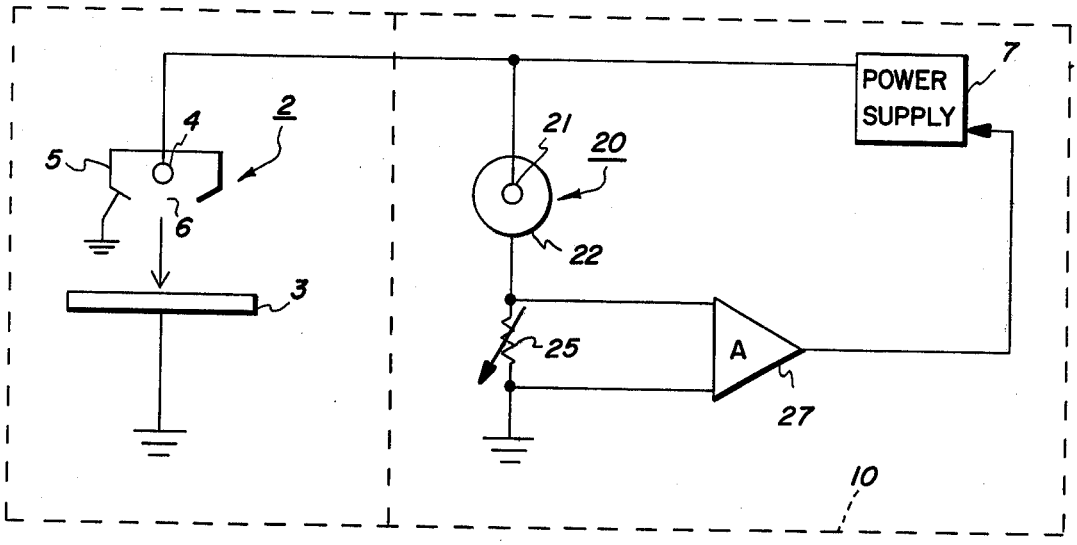

Referring to FIG. 1, there is shown an illustrative diagram of the invention including a controlled corona discharge device 2 which is located adjacent an imaging surface 3 of a xerographic system. The corona discharge device 2 includes a wire electrode 4 and a conductive shield 5 generally U-shaped in cross-section which runs the length of the electrode 4 and surrounding it but for a charge emitting opening 6. The wire 4 is conventionally supported by insulating blocks (not shown) located at opposed ends of the shield 5. The corona device 2 is energized from a power supply 7 which applies a voltage to the corona discharge electrode 4 of sufficient magnitude to generate a corona discharge about the wire, generally on the order of 3 KV to 8 KV. The details of construction of such corona discharge devices is well known in the art, and specific information may be had by reference to U.S. Pat. Nos. 2,836,725 or 2,879,395, among others.

The corona device 2 is operative to generate a flow of charge toward the imaging surface 3 to perform various functions in the xerographic process, as is well known in the art. The polarity of the charge may be positive or negative depending on the function to be performed by the charge in the xerographic process and the nature of the imaging surface.

As alluded to hereinbefore, the rate at which charge flows to the imaging surface 3 is dependent on various factors including ambient conditions of temperature and pressure etc. Recognizing this dependence, efforts have been made in the prior art to energize the corona device of xerographic machines from a constant current source so that the current delivered by the device 2 to the imaging surface remains constant despite such variations in ambient conditions. In addition to controlling the total amount of charge delivered to a charge collecting surface, it is sometimes very important that the density of charge along the length of the wire and thus across the width of the imaging surface be substantially uniform. Constant current arrangements, while operating to effectively hold the total charging current constant, fail to keep the current density uniform along the length of the wire. This is due to the fact that dirt and toner accumulate non-uniformally on the surface of the wire electrode. When a small spot of toner, for example, is deposited on the wire, current begins to fall off at that spot which results in a decrease in the total current supplied by the wire electrode. This fall-off in total current is sensed by the constant current source which raises total current to the previous value. Since corona current through the toner contaminated spot remains at a small value or zero, the non-uniformity of current delivered along the length of the wire is aggravated.

In order to compensate only for changes in output caused by ambient conditions the arrangement of the invention provides a second or control corona device 20 in the form of a wire corona electrode enclosed in a hollow conductive cylinder 22. The ends of the cylinder may be closed off by filter blocks which prevent dirt and toner present in the machine from entering the cylinder 22 but permit sufficient air circulating to emulate ambient conditions in the machine housing. The control corona device 20 is located within the xerographic machine housing 10 remote from the imaging surface 3 and is thus inoperable to deposit charge thereon. Any suitable location for the purpose will suffice.

The wire electrode 21 may be made of any suitable conductive material such as platinum, tungsten or stainless steel having an appropriate diameter to generate a corona discharge when a high potential source is applied thereto. The wire 21 may be connected to the same high voltage source 7 as is used to energize the first corona device 2.

A resistor 25 or other charging current sensor is connected in electrical series between the cylinder 22 and ground so that the voltage thereacross is directly related to the charging current delivered by the wire 21 of the control corona device to its surrounding conductive shield 22. The voltage across resistor 25 acts as a control signal which varies as a function of charging current delivered by the second corona device. The voltage across 25 may be amplified by a suitable inverting amplifier 27 and fed back to control the power supply 7. The power supply 7 is selected to be of a type which is variable in response to the magnitude of the control signal.

In operation, the power supply 7 is adjusted to supply a voltage to the controlled corona device 2 sufficient to generate a preselected charging current to the imaging surface 3. Under these conditions the control corona device 20 produces a charging current through resistor 25 which generates a control signal which is adjusted to be appropriate to maintain the voltage from the power supply constant.

If changes take place in the ambient conditions under which both corona devices are operating a change in output from the control corona device 20 takes place which is reflected as a change in the magnitude of the control signal from amplifier 27. The change in the control signal operates to adjust the power supply voltage to a different level sufficient to return the control signal to its previous value and concurrently changes the voltage delivered to the controlled corona device 2.

Thus if the current through resistor 25 decreases, the voltage across the resistor 25 decreases, which decrease is amplified and fed back to the control terminal of the power supply to increase the voltage applied to the electrodes of both corona devices thereby returning the charging currents delivered thereby to previous values.

Figure 2:
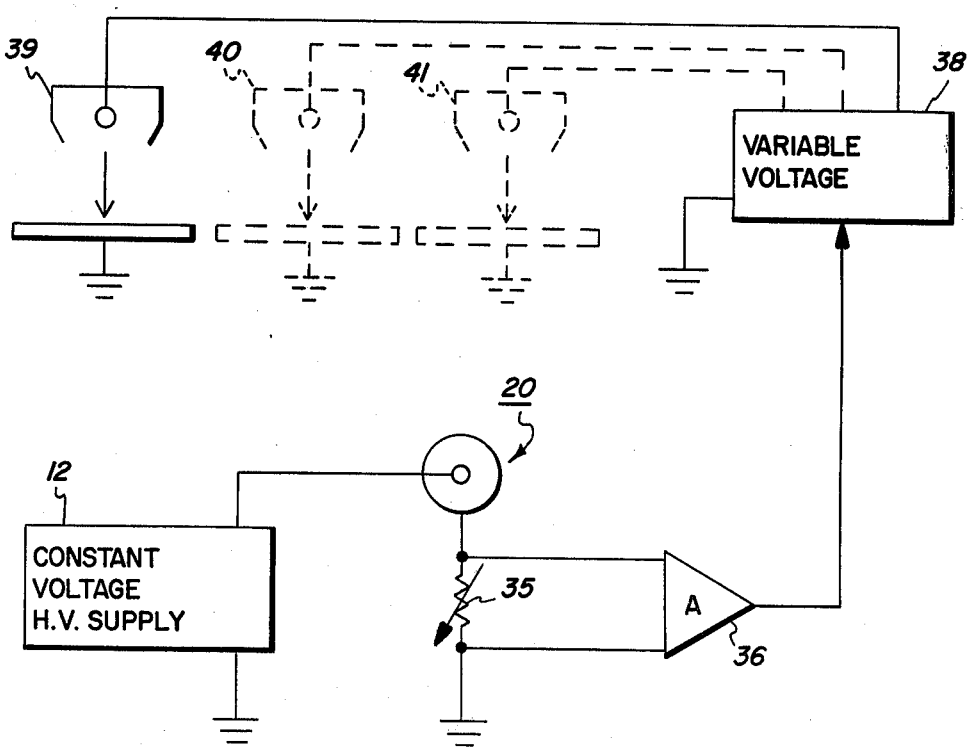

Another embodiment of the invention is shown in FIG. 2 wherein the control corotron 20, which is similar in construction to the control corotron shown in FIG. 1, is energized from a first constant high voltage power supply 12 to generate a current through a variable resistor 35. As was noted above, the control corotron 20 may be located in a portion of the machine remote from the xerographic processor and may include provisions to maintain the control corotron clean, that is, free from the accumulation of dirt and toner, but nevertheless, exposed to the environmental conditions within the machine. With this arrangement, the control corotron 20 provides a given current through the resistor 35 depending on the voltage of the source 12 and the geometrical configuration and characteristics of the control corotron 20. The current through the resistor 35 causes a control voltage to be generated thereacross which is fed to an inverting amplifier 36. The signal from the amplifier 36 is coupled to the control terminal of a variable high voltage supply 38, which supply is coupled to either one corotron 39 or a plurality of corotrons 40 and 41, shown in dotted lines. The overall operation of the arrangement of FIG. 2 is similar to that described in reference to FIG. 1, the difference being that the arrangement of FIG. 2 does not provide for an adjustment of the current through the control corotron 20 by means of a feedback path to the power supply. More specifically, two separate power supplies are employed; the first for energizing the control corotron and the second for energizing the controlled or xerographically performing corotrons 39, 40, and 41.

In operation, a preselected current is made to flow through the resistor 35 by selection of the magnitude of the voltage supply by the power supply 12 and the configuration of the corotron 20. This preselected current is selected to generate through the variable resistor 35 a predetermined control voltage which when amplified by the inverting amplifier 36 dictates that the variable supply 38 provide a specified magnitude of voltage to the corotrons 39, 40, and 41, which may or may not be different from one another. If a change takes place in the environmental conditions under which the corotron 20 is operating, this change is reflected as a change in the voltage across the resistor 35 and a corresponding change in the control signal fed out of the amplifier 36 to the variable voltage supply which results in a corresponding change in the voltage applied to the corona wires of the corotrons 39, 40 and 41. Thus, if the current generated by corotron 20 decreases, the voltage across resistor 35 decreases, which voltage is amplified and inverted by an appropriate circuit to generate a signal which increases the voltage applied to the corona wires of the corotrons 39, 40, and 41.

Figure 3:
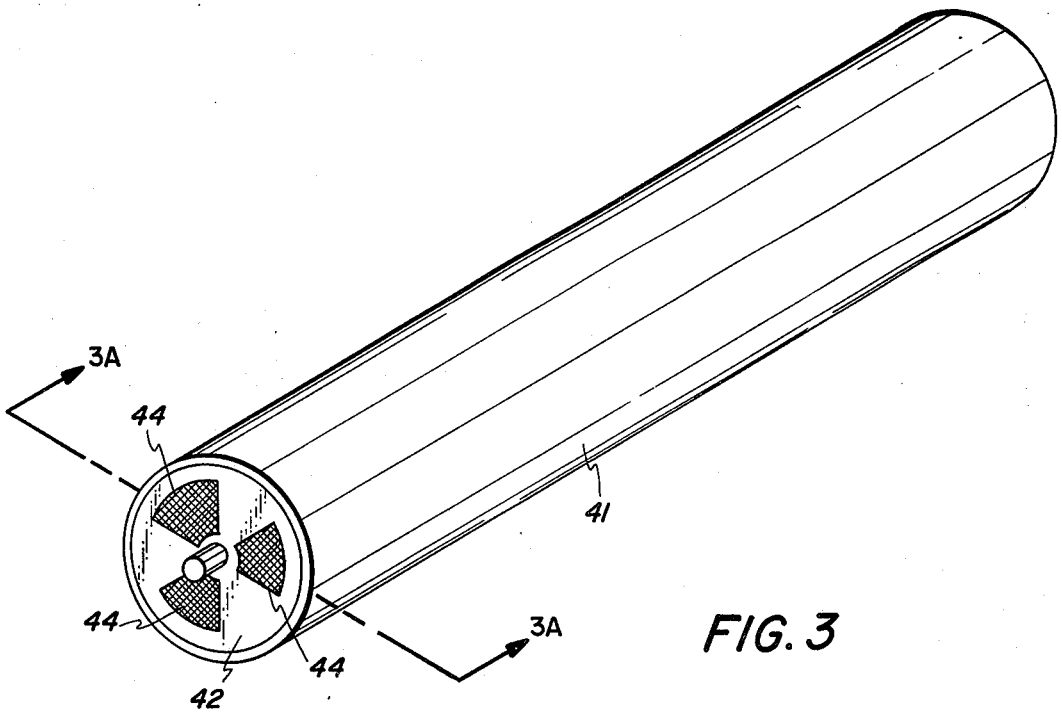
Figure 3A:
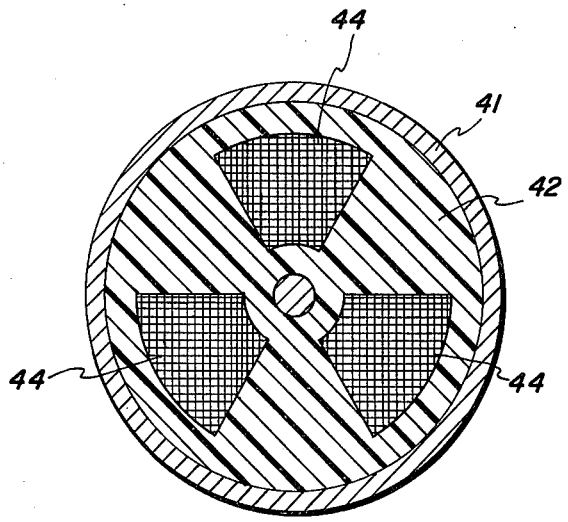

FIGS. 3 and 3A illustrate in perspective a specific geometric form for the control corotron used in the arrangements of the invention. It is seen to comprise a hollow metallic cylinder or tube 41 open at both ends thereof. The ends of the cylinder 41 are capped by insulating end blocks 42 including openings in which appropriate filters 44 may be mounted. The end blocks serve the dual function of supporting a corona wire and a filtering means, the latter permitting the corona wire to be exposed to the ambient conditions within the machine, while concurrently preventing the entry of toner and dirt into the control corotron which would otherwise contaminate it. The overall size of the control corotron shown in FIG. 3 may be varied to produce specific characteristics which may enhance the performance of the arrangement of the invention by providing, for example, a steep current versus voltage characteristic curve as will be explained in greater detail hereinafter.

Figure 4:
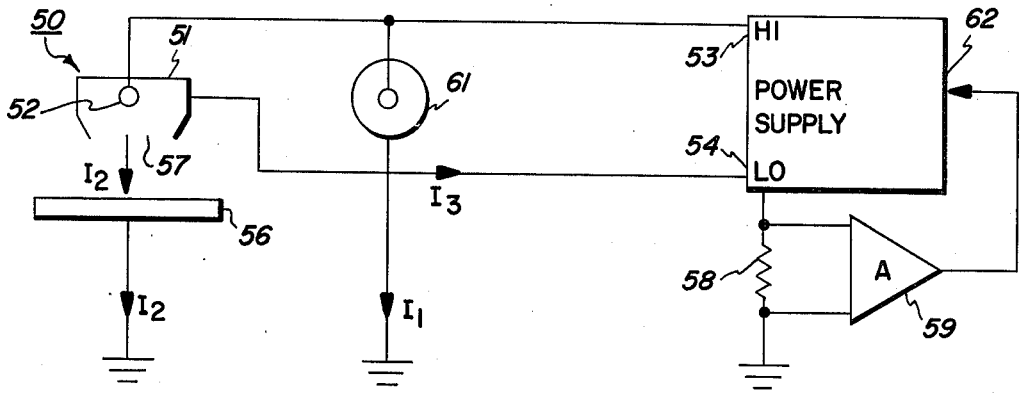
Figure 5:
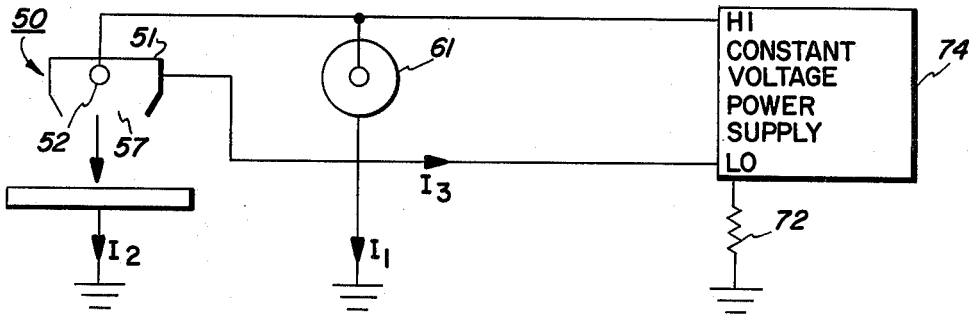
Figure 6:
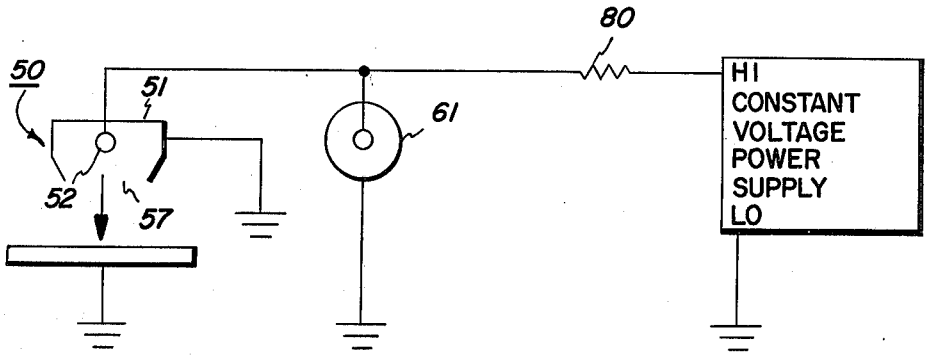

Additional arrangements in accordance with the invention for controlling a xerographically functional corona device by means of a control corona device are shown in FIGS. 4 through 6. In FIGS. 4 and 5, arrangements are shown whereby only the current delivered by the controlled corotron to a charge receiving or imaging surface is controlled, rather than the total current through the controlled corotron which includes both the current to the charge receiving surface and the current to the shield.

Referring specifically to FIG. 4, there is shown a controlled corotron 50 comprising a conductive shield 51 having a generally U-shaped cross-section which partially surrounds a corona wire or electrode 52 but for an ion exit opening 57 through which charges pass to the charge receiving surface 56. The wire electrode 52 is supported in conventional fashion by means of insulating blocks (not shown) located at opposite ends of the U-shaped shield. The specific details of the construction of such corona devices are well known and may be had from U.S. Pat. No. 2,836,725 among others. The corona wire 52 is coupled by a suitable lead to one terminal 53 of a variable high voltage power supply 62. The shield 51 is coupled via another lead to the other terminal 54 of the power supply 62. The imaging surface 56, as is well known, may comprise a layer of photo-conductive material deposited on a grounded conductive substrate and may be in the form of a conventional xerographic drum which therefore rotates beneath the ion exit slit 57. The terminal 54 of the power supply is also connected to ground via a suitable resistor 58. A sensing or control corotron 61 is connected in parallel with the controlled corotron between ground and the terminal 53 of the power supply. The sensing corotron 61 is constructed in a manner similar to that described with reference to FIGS. 1, 2, and 3. In operation, when the high voltage supply is coupled to the corotron 50, two separate currents flow therethrough. The first current $I_2$ travels from the corona electrode 52 to the imaging surface 56 and to ground. The second current $I_3$ travels from the corona discharge electrode 52 to the surrounding conductive shield 51 and back to the terminal 54 of the power supply.

The corona device 61, when coupled to the power supply 62 produces a single current $I_1$ which is delivered from the corona wire or electrode of the corona device 61 to the surrounding shield and then to ground. As a result of the above arrangement, it can be seen that the sum of the currents $I_1$ and $I_2$ flows through the resistor 58 on its way to the terminal 54 of the power supply and a change in either of these currents results in a change in the voltage across the resistor 58. Since the voltage across the resistor 58 is fed back via an inverting amplifier 59 to a control terminal on the variable power supply 62, it is seen that a control arrangement is thereby provided which adjusts only for changes in the current delivered by the corotron 50 to the collecting surface 56 ($I_2$) or the current flowing through the sensing corotron ($I_1$). The shield current $I_3$ is bypassed in this manner to the low side of the power supply and does not affect the control signal generated across the control resistor 58.

The arrangement of FIG. 5 is similar in construction and operation to that of FIG. 4 except for the fact that the feedback loop from the amplifier back to the power supply is eliminated, the variable power supply is replaced by a constant high voltage power supply 74, and the sensing resistor 58 is replaced by a much larger resistor 72. In the operation of this arrangement, the current $I_2$ flowing to the imaging surface 56 and the current $I_1$ flowing through the sensor corotron 61 flow through the resistor 72. Therefore, any changes in these currents results in a change in the voltage drop across resistor 72 which is directly reflected as a change in the potential applied to both the controlled corotron 50 and the control corotron 61, since they are both connected in parallel with the high voltage supply 74 and the resistor 72. As the arrangement of FIG. 5 changes in the current $I_3$ drawn by the shield of the controlled corotron do not affect the stabilization arrangement since they are bypassed from the shield 51 to the terminal 54 of the constant voltage power supply which is held at a potential below ground.

Another self-regulating type of arrangement as shown in FIG. 6. In the arrangement a resistor 80 is connected in series with both the controlled corotron 50 and the control corotron 61 which are themselves connected again in parallel with each other. The shield 51 is grounded so that total current to the corona device 50 is regulated. In operation, any variation in the current drawn by the sensor or control corotron 61 changes the voltage across resistor 80 resulting in a change in the potential applied to both corotrons to thereby maintain a constant current through both corotrons. For example, if environmental conditions reduce the amount of current drawn by the sensor corotron 61, a corresponding reduction in current through the common resistor 80 takes place which results in a smaller voltage drop thereacross. This, in turn, increases the voltage applied across the parallel combination of the controlled and the control corotron. Likewise, if the current through the sensor corotron is increased due to changes in the environment, an increase in the voltage drop across the common resistor occurs which in turn reduces the magnitude of voltage available for application across the parallel combination of control and controlled corotrons.

While the embodiments described above have been directed to d.c. corona devices, it is obvious that the same arrangements are applicable to corona devices operated from an a.c. source.

While this invention has been described in conjuction with a specific embodiment thereof, it is evident that many alternatives, modifications, and variations will be apparent to those skilled in the art. Accordingly, it is intended to embrace all such alternatives, modifications, and variations that fall within the spirit and broad scope of the appended claims.

What is claimed is:

1. In combination, an imaging surface, a first corona discharge device located adjacent said surface for depositing charge on said imaging surface, said device including a first electrode and a first shield partially surrounding said electrode, power supply means for applying a corona energizing potential to said first electrode, a housing within which said first corona device and imaging surface are located, a second corona discharge device located within said housing remote from said imaging surface and inoperative to deposit charge on said imaging surface, said second device comprising a second corona dischage electrode and an adjacent conductive surface for collecting charge emitted from said second corona device, electrical means for developing a control signal which is a function of the rate at which said second device is depositing charge on said adjacent surface, and means for varying said power supply means in response to said control signal.

2. The combination recited in claim 1 wherein said second electrode comprises a wire and said adjacent surface comprises a conductive cylinder surroundng said wire.

3. The combination recited in claim 2 wherein said wire is located substantially on the axis of said cylinder.

4. The combination recited in claim 1 wherein said electrical means comprises a resistor in series with said adjacent surface and an amplifier coupled across said resistor, the output of said amplifier coupled to said means for varying.

* * * * *